US007770330B2

(12) United States Patent
Brown et al.

(10) Patent No.: US 7,770,330 B2
(45) Date of Patent: Aug. 10, 2010

(54) METHOD OF OPENING AN APPLIANCE DOOR

(75) Inventors: Justin T. Brown, Louisville, KY (US); Brian Henninger, LaGrange, KY (US); Philip Ames Barber, Louisville, KY (US); Vern Alden Neal, Louisville, KY (US)

(73) Assignee: General Electric Company, Schenectady, NY (US)

( * ) Notice: Subject to any disclaimer, the term of this patent is extended or adjusted under 35 U.S.C. 154(b) by 283 days.

(21) Appl. No.: 11/959,808

(22) Filed: Dec. 19, 2007

(65) Prior Publication Data

US 2009/0158669 A1 Jun. 25, 2009

(51) Int. Cl.
*E06B 3/00* (2006.01)

(52) U.S. Cl. ..... 49/506; 49/257; 49/258; 49/259; 49/260

(58) Field of Classification Search ..... 49/506, 49/381, 240, 245, 254, 257, 258, 260, 259; 126/190; 16/366, 368, 369, 370, 371, 286, 16/287, 288, 289; 312/327, 328, 323
See application file for complete search history.

(56) References Cited

U.S. PATENT DOCUMENTS 1,873,522 A * 8/1932 Abbott et al. ..... 109/70
3,286,706 A * 11/1966 Hoppe ..... 126/194
3,481,288 A * 12/1969 Teleky ..... 109/58
3,838,538 A * 10/1974 Burford ..... 49/258
4,580,828 A * 4/1986 Jones ..... 296/57.1
4,836,394 A * 6/1989 Glomski ..... 220/811
4,932,160 A * 6/1990 Sperko ..... 49/254
5,025,776 A * 6/1991 Hanley et al. ..... 126/194
5,050,345 A * 9/1991 Nakanishi ..... 49/279
6,305,737 B1 * 10/2001 Corder et al. ..... 296/146.11
6,447,233 B1 * 9/2002 Denker ..... 414/217.1
7,255,101 B2 * 8/2007 Grutzke et al. ..... 126/194
7,404,363 B2 * 7/2008 Dunstan ..... 109/70

* cited by examiner

*Primary Examiner*—Katherine W Mitchell
*Assistant Examiner*—Catherine A Kelly
(74) *Attorney, Agent, or Firm*—Global Patent Operation; Douglas D. Zhang

(57) ABSTRACT

A method of opening an appliance door includes translating the door up and away from a unit so as to clear a lower edge of a physical constraint, thus allowing for gaps to be minimized, further translating the appliance door out so that its handle would not make contact with an adjacent door should the adjacent door be closed or opened while the appliance door is opened, thus allowing the appliance door to be lowered when the same is fully opened in order to increase the usable height and to reduce the gaps below and above the appliance door.

8 Claims, 9 Drawing Sheets

METHOD OF OPENING AN APPLIANCE DOOR

BACKGROUND OF THE INVENTION

1. Field of the Invention

The embodiments disclosed relate generally to appliances and more particularly to a method of opening an appliance door.

2. Description of the Related Art

With the advancement of technology the number of kitchen appliances in a normal household has increased. In the past, a typical household kitchen may have included a stove and a refrigerator, but now it may in addition incorporate more than one oven, a microwave, and a dishwasher to name just a few. As the number of appliances increased, the available useful space has decreased, constraining designers to place these appliances closer and closer together. One such example is a freestanding, dual-cavity unit incorporating one oven on top of another.

As these appliances are disposed closer together, it is desirable to maintain customer appeal by minimizing separation gaps and proper operation of individual doors without interference with other appliances, while, at the same time, maximizing the usable height of the appliance as much as possible. As used herein throughout, usable height is defined as the distance from a rack disposed inside an appliance at its lowest position to the inside top surface of the appliance, as for example, the broil element of an oven. As appreciated by those of ordinary skill, as the usable height increases the size of a cookware to be used in the appliance increases, making the appliance more functional and desirable from a customer's point of view.

It would therefore be desirable to develop a method of opening the door of an appliance so as to increase usable height, while minimizing the separation gap to an adjacent appliance or another physical constraint.

BRIEF SUMMARY OF THE INVENTION

One or more of the above-summarized needs or others known in the art are addressed by methods of opening an appliance door of an appliance, the appliance door having inner liner, an inner liner, an outer liner, and a front surface. These methods including the steps of, while rotating the appliance door about a pivot point, translating the appliance door from a closed position to a first intermediate position, the pivot point being translated along an X direction away from the appliance by an amount $\Delta x_1$ measured with respect to a vertical datum line and upward along a Y direction by an amount $\Delta y_1$ measured with respect to a vertical datum line; while rotating the appliance door about the pivot point, translating the appliance door from the first intermediate position to a second intermediate position, the pivot point being translated along the X direction away from the appliance by an amount $\Delta x_2$ measured with respect to the vertical datum line and downward along the Y direction by an amount $\Delta y_2$ measured with respect to a vertical datum line; and while rotating the appliance door about the pivot point, translating the appliance door from the second intermediate position to an opened position, the pivot point being translated along the X direction away from the appliance by an amount $\Delta x_3$ measured with respect to the vertical datum line and downward along the Y direction by an amount $\Delta y_3$ measured with respect to a vertical datum line.

The above brief description sets forth features of the various embodiments of the present invention in order that the detailed description that follows may be better understood, and in order that the present contributions to the art may be better appreciated. There are, of course, other features of the invention that will be described hereinafter and which will be for the subject matter of the appended claims.

In this respect, before explaining several embodiments of the invention in detail, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

Further, the purpose of the foregoing Abstract is to enable a patent examiner and/or the public generally, and especially scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
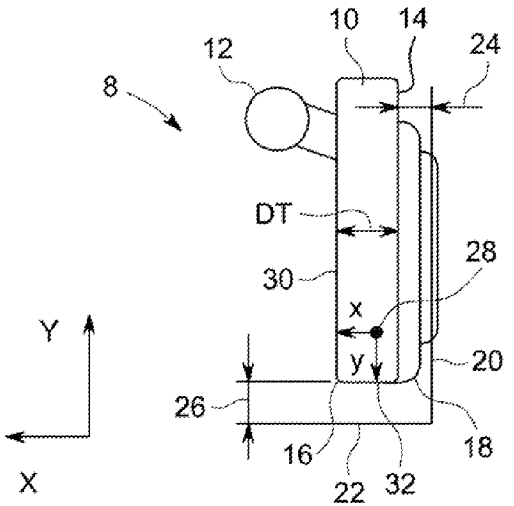
FIG. 1 illustrates four side views of an appliance door corresponding to a closed or home position, a first intermediate position, a second intermediate position, and a final or opened position, respectively.

The embodiments disclosed relate generally to appliances and more particularly to a method of opening an appliance door. In the disclosed methods, an upper door translates up and away from a unit so as to clear a lower edge of a physical constraint, such as a door of any components mounted below the door or the edge of a cabinet, thus allowing for gaps to be minimized. The door then continues to translate out so that its handle would not make contact with the lower door should the lower door be closed or opened while the upper door is opened. The translation outward also allows the upper door to be lowered when the same is fully opened, thus lowering the lowest rack position without compromising any clearance between the rack and the door. Lowering the rack increases the usable height and reduces the gaps below and above door. Referring now to the drawings, wherein like reference numerals designate identical or corresponding parts throughout the several views, several embodiments of the disclosed methods will be described.

Figure 1B:
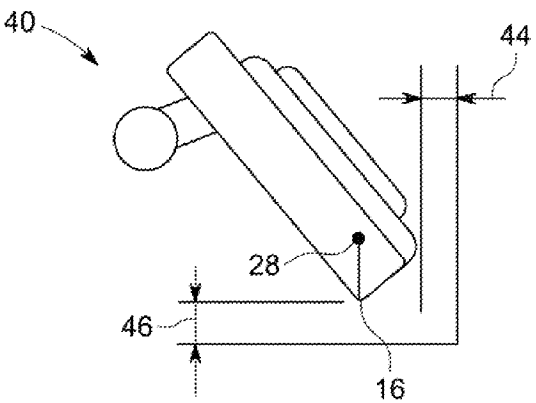
Figure 1C:
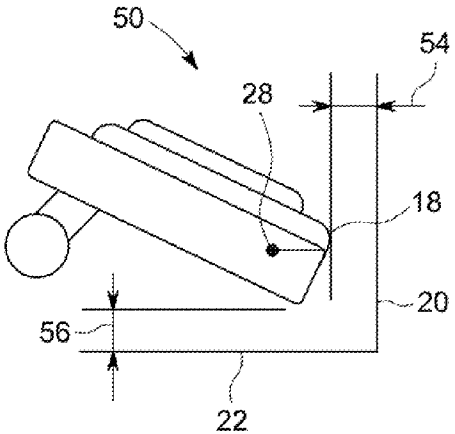
Figure 1D:
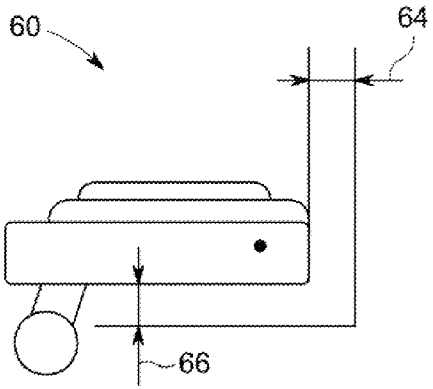

FIG. 1 illustrates four side views of an appliance door 10 corresponding to a closed or home position 8 in FIG. 1A, a first intermediate position 40 in FIG. 1B, a second intermediate position 50 in FIG. 1C, and a final or opened position 60 in FIG. 1D. As shown, the appliance door 10 includes a handle 12, an inner liner 14, an outer lower corner 16, and an inner lower corner 18. In order to better explain the various positions of the appliance door 10 from the closed to the opened positions, a vertical datum line 20 and a horizontal datum line 22 are used in FIGS. 1A-1D. For example, but not to be considered as a limitation, the vertical datum line 20 may be the physical location of a vertical panel of the appliance and the horizontal datum line 22 may represent the top location of a lower door of the appliance, in the case of a freestanding, double-cavity unit (e.g., a double-oven appliance). In the explanations that follow, a two dimensional coordinate system is defined with one axis parallel to the horizontal datum line 22 (the X axis) and with another parallel to the vertical datum line 20 (the Y axis), as shown in FIG. 1A. As used herein throughout, "inner" and "outer" refer to positions close to and away from the vertical datum line 20, respectively. In addition, as shown in FIGS. 1B and 1C, the first intermediate position 40 is defined by the position of the appliance door 10 when a line passing through a pivot point 28 and the outer lower corner 16 is vertical; and the second intermediate position 50 is defined by the position of the appliance door 10 when a line passing through the pivot point 28 and the inner lower corner 18 is horizontal. As further illustrated in FIG. 1A, in the closed position 8, a first horizontal gap 24, or $Gap_{x,1}$, and a first vertical gap 26, or $Gap_{y,1}$, are defined between the appliance door 10 and the vertical datum line 20 and the horizontal datum line 22, respectively. Similar horizontal gaps 44, 54, and 64, or $Gap_{x,2}$, $Gap_{x,3}$, and $Gap_{x,4}$, and vertical gaps 46, 56, and 66, or $Gap_{y,2}$, $Gap_{y,3}$, and $Gap_{y,4}$, exist between the appliance door 10 and the datum lines 20 and 22. As it will become apparent from one of ordinary skill in the applicable arts, these vertical and horizontal gaps may have the same values or different ones and the subject matter disclosed herein is not limited in any way by a specific value of any one of these gaps. In addition, as noted in FIG. 1A, the appliance door 10 has a thickness, DT, and the pivot point 28 about which the door rotates, the pivot point 28 being located at a distance x from a front surface 30 of the appliance door 10 and a distance y from a lower surface 32 of the appliance door 10.

As shown in FIG. 1, in the disclosed subject matter, when opening the appliance door 10, the same is first translates up and away from the unit from the closed position 8 to the first intermediate position 40. In the first intermediate position 40, since the appliance door 10 has moved out, the inner lower corner 18 clears the second horizontal gap 44, or $Gap_{x,2}$, which may be smaller, larger, or of the same size as that of the first horizontal gap 24, or $Gap_{x,1}$, thus allowing the appliance door 10 to clear a lower edge of a physical constraint, such as a door of any components mounted below the appliance door 10 or the edge of a cabinet, and a vertical gap between appliances to be minimized.

From the first intermediate position 40 to the second intermediate position 50 in FIG. 1, the appliance door 10 rotates more about the pivot point 28 and translates further out and down in the X and Y directions, respectively, thus allowing the appliance door 10 to clear a lower edge of a physical constraint, such as a door of any components mounted below the appliance door 10 or the edge of a cabinet while at the same time allowing for a vertical gap between appliances to be minimized. Finally, the appliance door 10 rotates from the second intermediate position 50 to the opened position 60, while continuing to translate out so that the handle 12 of the appliance door 10 does not make contact with a lower door should the lower door be closed or opened while the appliance door 10 is opened. The translation outward also allows the appliance door 10 to be lowered when the same is fully opened, thus lowering the lowest rack position without compromising any clearance between the rack and the door. As already mentioned, lowering the rack increases the usable height and reduces the gaps below and above the appliance door 10. The exemplary translations in the X and Y directions will be now further quantified.

Figure 2B:
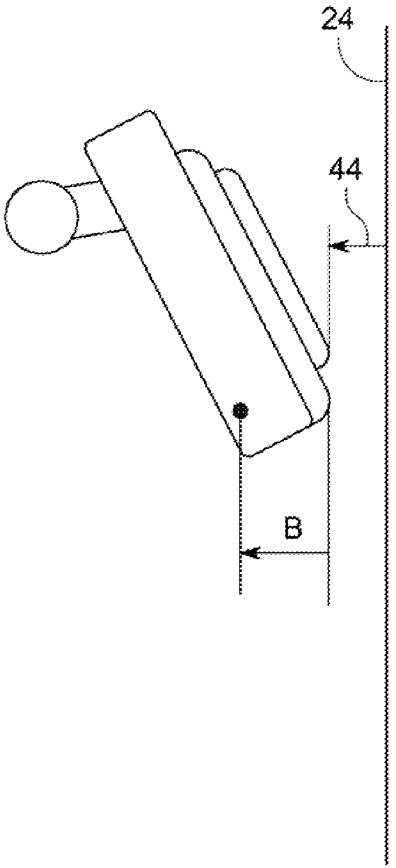
FIGS. 2 and 3 illustrate respectively pivot X and Y translations for the first intermediate position of the door of FIG. 1.
Figure 2A:
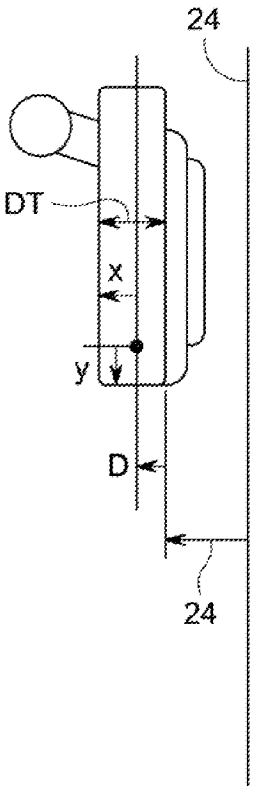
Figure 3:
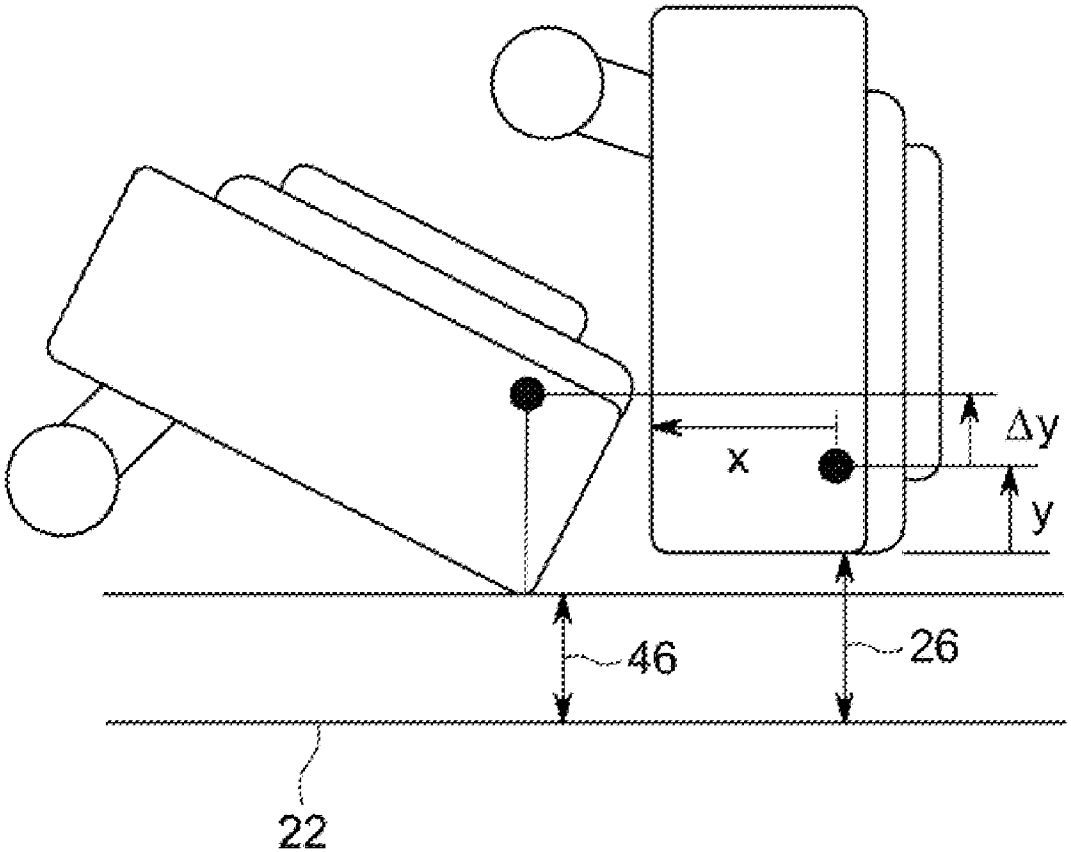

FIGS. 2A, 2B and 3 illustrate respectively pivot X and Y translations as the appliance door 10 moves from the closed position 8 (FIG. 2A) to the first intermediate position 40 (FIG. 2B). The pivot X translation, $\Delta x_1$, is given by:

$$\Delta x_1=(Gap_{x,2}+B)-(Gap_{x,1}+D) \tag{1}$$

where D is the width of the door, DT, subtract from the distance from the pivot point 28 to the front surface 30 of the appliance door 10, x (i.e., D=DT−x), and B is given by:

$$B=\sqrt{D^2+y^2}\cos\left[90-\tan^{-1}\left(\frac{x}{y}\right)-\tan^{-1}\left(\frac{D}{y}\right)\right], \tag{2}$$

where x and y have been defined in FIG. 1.

The pivot Y translation, $\Delta y_1$, in FIG. 3, is given by:

$$\Delta y_1=(Gap_{y,2}+\sqrt{x^2+y^2})-(Gap_{y,1}+y). \tag{3}$$

As such, when the appliance door 10 moves from the closed position 8 to the first intermediate position 40 the door rotates about the pivot point 28 while the pivot point translates up by an amount equal to $\Delta y_1$ and away from the vertical datum line 20 by an amount equal to $\Delta x_1$.

For example, for an appliance door 10, where x=0.30 in, y=0.50 in, the distance from its innermost surface to its outermost surface is 1.20 in (i.e., D=1.20−x=0.90 in), the first gap 24, or $Gap_{x,1}$, to the surface most likely to interfere with the innermost surface of the door while in the closed position 8 is equal to 0.25 in, the second horizontal gap 44, or $Gap_{x,2}$, to the surface most likely to interfere with the innermost surface of the appliance door 10 while in the first intermediate position 40 is equal to 0.20 in, the first vertical gap 26, or $Gap_{y,1}$, to the surface most likely to interfere with the bottom surface of the door while in the closed position 8 is equal to 0.25 in, and the second vertical gap 46, or $Gap_{y,2}$, to the surface most likely to interfere with the bottom surface of the door while in the first intermediate position 40 is equal to 0.20 in, calculations of $\Delta x_1$ and $\Delta y_1$ based on the above-noted equations, would result as follows:

$$B = \sqrt{0.9^2 + 0.5^2}\cos\left[90 - \tan^{-1}\left(\frac{0.3}{0.5}\right) - \tan^{-1}\left(\frac{0.9}{0.5}\right)\right] = 1.31\text{ in},$$

$$\Delta x_1 = (Gap_{x,2} + B) - (Gap_{x,1} - D) = 0.20 + 1.31 - 0.25 - 0.9 = 0.36\text{ in},$$

and $$\Delta y_1 = \left(Gap_{y,2} + \sqrt{x^2 + y^2}\right) - (Gap_{y,1} + y) = 0.20 + \sqrt{0.3^2 + 0.5^2} - (0.25 + 0.5) = 0.033\text{ in}.$$

Figure 4B:
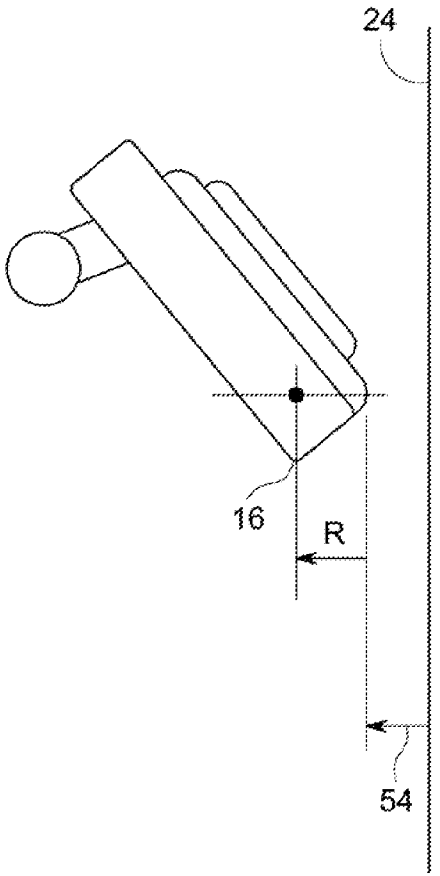
FIGS. 4 and 5 illustrate respectively pivot X and Y translations corresponding to the second intermediate position of the door of FIG. 1.
Figure 4A:
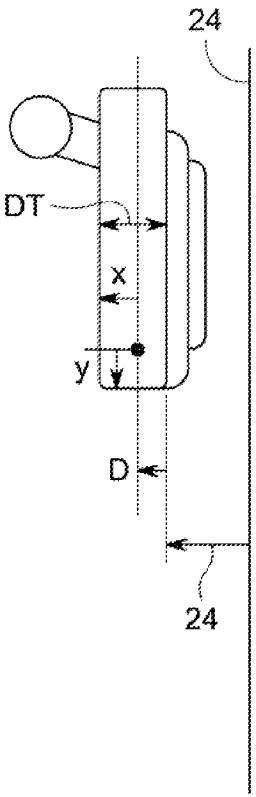
Figure 5:
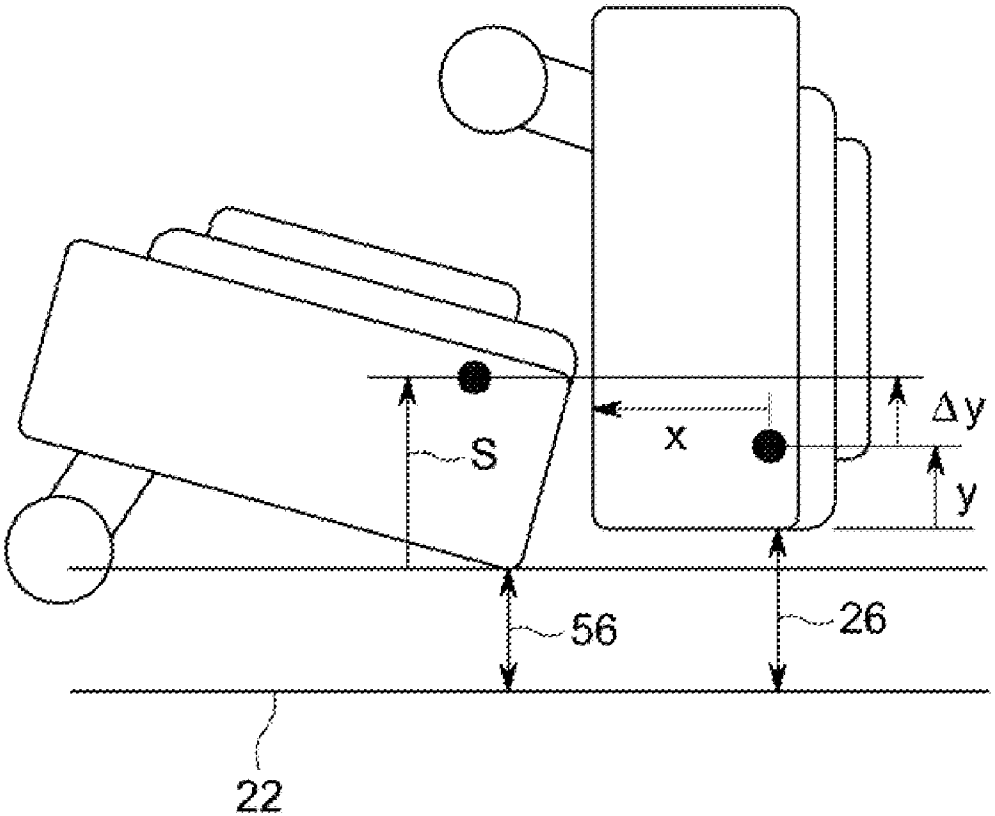

FIGS. 4A, 4B and 5 illustrate respectively pivot X and Y translations from the opened position 8 (FIG. 4A) to the second intermediate position 50 (FIG. 4B) of the appliance door 10. The pivot X translation from the closed position 8 to the second intermediate position 50, $\Delta x_2$, is given by:

$$\Delta x_2 = (Gap_{x,3} + R) - (Gap_{x,1} + D) \quad (4)$$

where $Gap_{x,1}$, $Gap_{x,3}$, and D are as previously defined and R is given by:

$$R = \sqrt{D^2 + y^2}. \quad (5)$$

The pivot Y translation as the appliance door 10 moves from the closed position 8 to the second intermediate position 50, $\Delta y_2$, is given by:

$$\Delta y_2 = (Gap_{y,3} + S) - (Gap_{y,1} + y) \quad (6)$$

where $Gap_{y,1}$, $Gap_{y,3}$, and y are as previously defined and S is given by:

$$S = \sqrt{x^2 + y^2}\cos\left(90 - \tan^{-1}\left(\frac{x}{y}\right) - \tan^{-1}\left(\frac{D}{y}\right)\right). \quad (7)$$

As such, when the appliance door 10 moves from the first intermediate position 40 to the second intermediate position 50 it rotates further about the pivot point 28 while the pivot point translates down by an amount equal to $\Delta y_2 - \Delta y_1$ and further away from the vertical datum line 20 by an amount equal to $\Delta x_2 - \Delta x_1$.

Continuing with the example from above, where $Gap_{y,3}$ to the surface most likely to interfere with the innermost surface of the door while in the second intermediate position is taken as 2 in, calculations for $\Delta x_2$ and $\Delta y_2$ would result as follows:

$R = \sqrt{D^2 + y^2} = \sqrt{0.9^2 + 0.5^2} = 1.03$ in, $\Delta x_2 = (Gap_{x,3} + R) - (Gap_{x,1} + D) = 2.0 + 1.03 - 0.25 - 0.9 = 1.88$ in $\Delta x_2 - \Delta x_1 = 1.88 - 0.36 = 1.52$ in, i.e., the second intermediate position 50 is further out compared to the first intermediate position 40, $$S = \sqrt{0.3^2 + 0.5^2}\cos\left(90 - \tan^{-1}\left(\frac{0.3}{0.5}\right) - \tan^{-1}\left(\frac{0.9}{0.5}\right)\right) = 0.58\text{ in},$$

$$\Delta y_2 = (Gap_{y,3} + S) - (Gap_{y,1} + y) = (0.20 + 0.58) - (0.25 + 0.5) = 0.03\text{ in},$$

and $\Delta y_2 - \Delta y_1 = 0.030 - 0.033 = -0.003$ in, i.e., the second intermediate position 50 is lower than the first intermediate position 40 with respect to the datum line 22.

Figure 6:
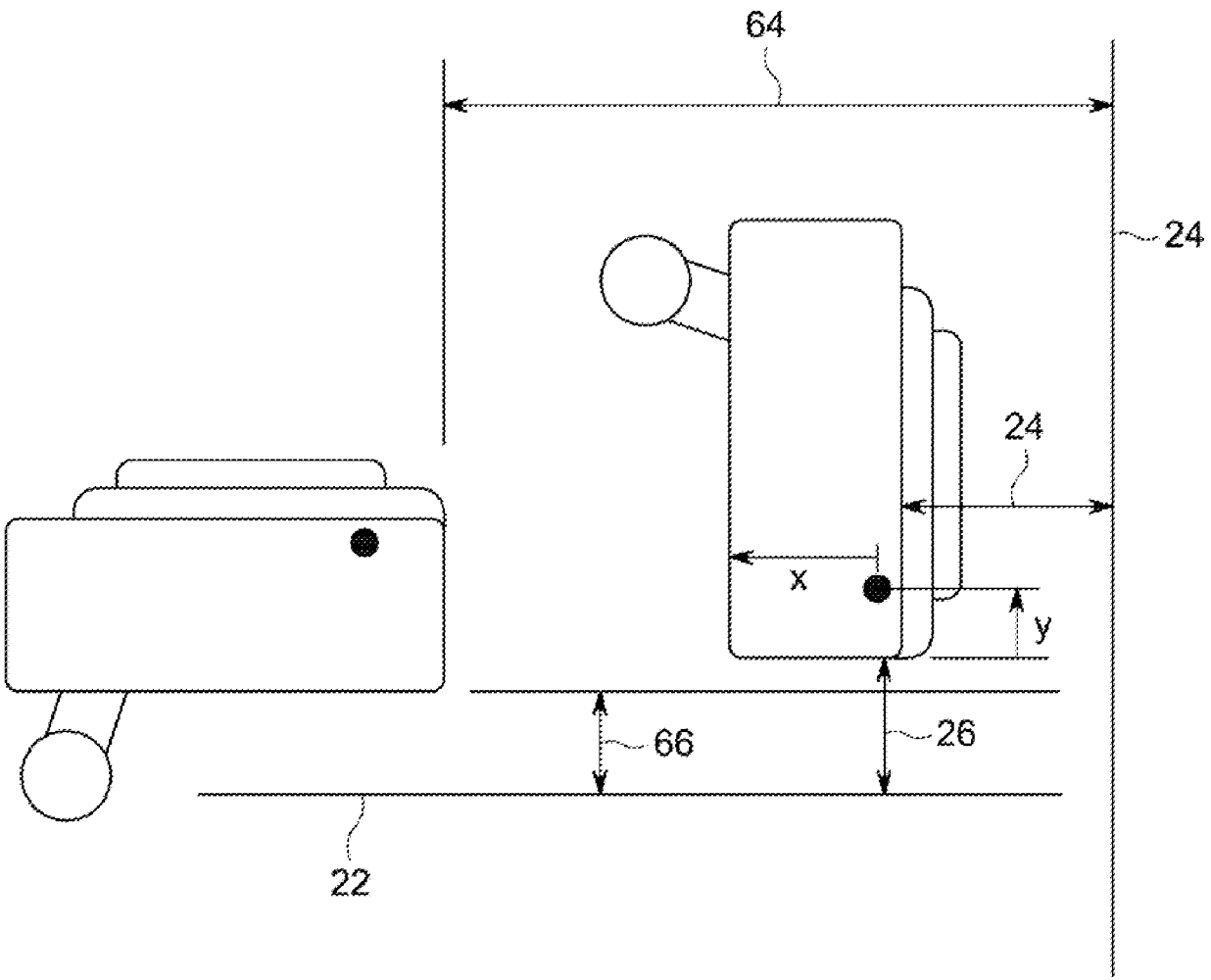
FIG. 6 illustrates pivot X and Y translations corresponding to the final or opened position of the door of FIG. 1.

Finally, FIG. 6 illustrates pivot X and Y translations from the closed position 8 to the opened position 60. The translations of the pivot point 28 in the X and Y directions, $\Delta x_3$ and $\Delta y_3$, respectively, are given by:

$$\Delta x_3 = (Gap_{x,4} + y) - (Gap_{x,1} + D) \text{ and} \quad (8)$$

$$\Delta y_3 = (Gap_{y,4} + x) - (Gap_{y,1} + y). \quad (9)$$

In a standard double-oven freestanding unit, an exemplary total translation of the appliance door 10 in the X direction is approximately about 35.6 mm (1.4 in). Using the same example as before and with the fourth horizontal gap, $Gap_{x,4}$=2.5 in and the fourth vertical gap, $Gap_{y,4}$, to the surface most likely to interfere with the innermost surface of the door while in the full open position 60 is 0.2 in, the calculations for of $\Delta x_3$ and $\Delta y_3$ would result as follows:

$\Delta x_3 = (Gap_{x,4} + y) - (Gap_{x,1} + D) = (2.5 + 0.5) - (0.20 + 0.9) = 1.9$ in, and $\Delta y_3 = (Gap_{y,4} + x) - (Gap_{y,1} + y) = (0.2 + 0.3) - (0.25 + 0.5) = -0.25$ in, which would be the lowest position for the appliance door 10 as measured from the datum line 22.

Figure 7:
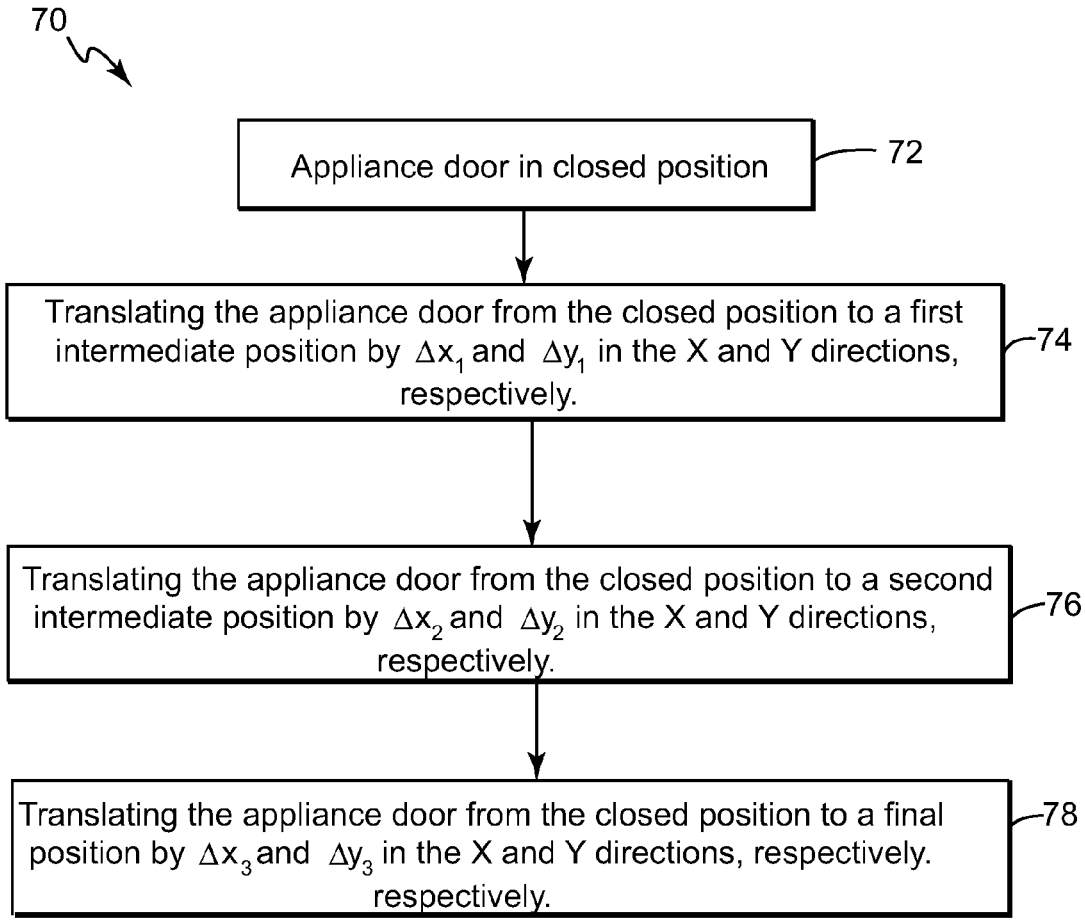
FIG. 7 illustrated a flowchart outlining a method of opening an appliance door.

FIG. 7 illustrates a flowchart 70 of an exemplary method disclosed herein to perform the opening and closing of the appliance door 10 as just described in detail hereinabove. As shown, the appliance door 10 is first on a closed position at 72. The first step of the method at 74 is opening the appliance door 10 by translating the same up and away from the unit from the closed position to a first intermediate position. In step 74, the appliance door 10 translates from the closed position to the first intermediate position in the X and Y directions by amounts of $\Delta x_1$ and $\Delta y_1$—the values of these displacements being given by the above-noted equations, as already explained. In step 76, the appliance door is further translated away from the appliance and downward—the total displacement along the X and Y directions being given by $\Delta x_2$ and $\Delta y_2$. At 78, the appliance door is further translated away from the appliance and downward to its fully opened position—the total displacement along the X and Y directions being given by $\Delta x_3$ and $\Delta y_3$.

Figure 8:
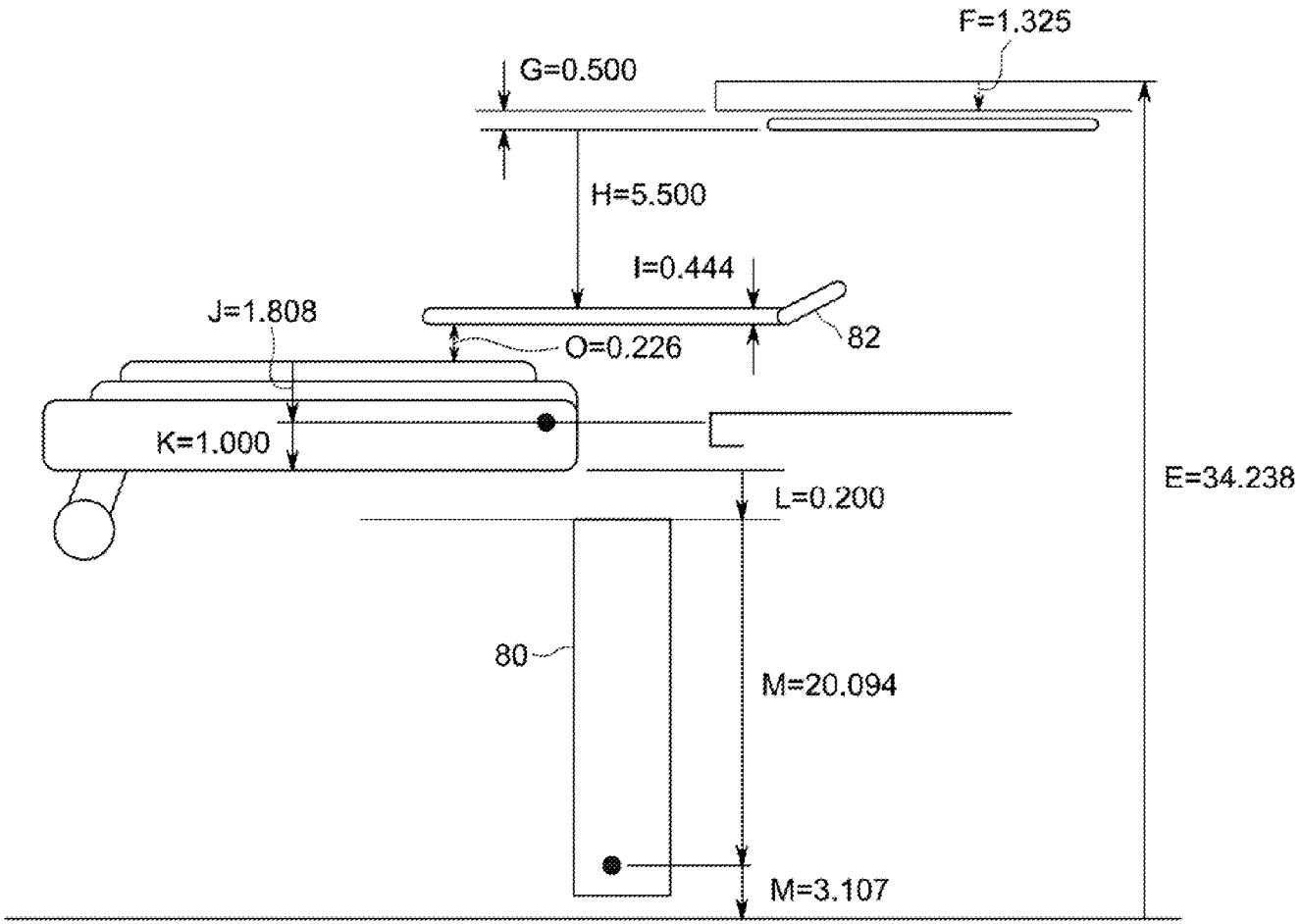
FIG. 8 illustrates a door Y translation for a freestanding dual-cavity unit at the final opened position.
Figure 9:
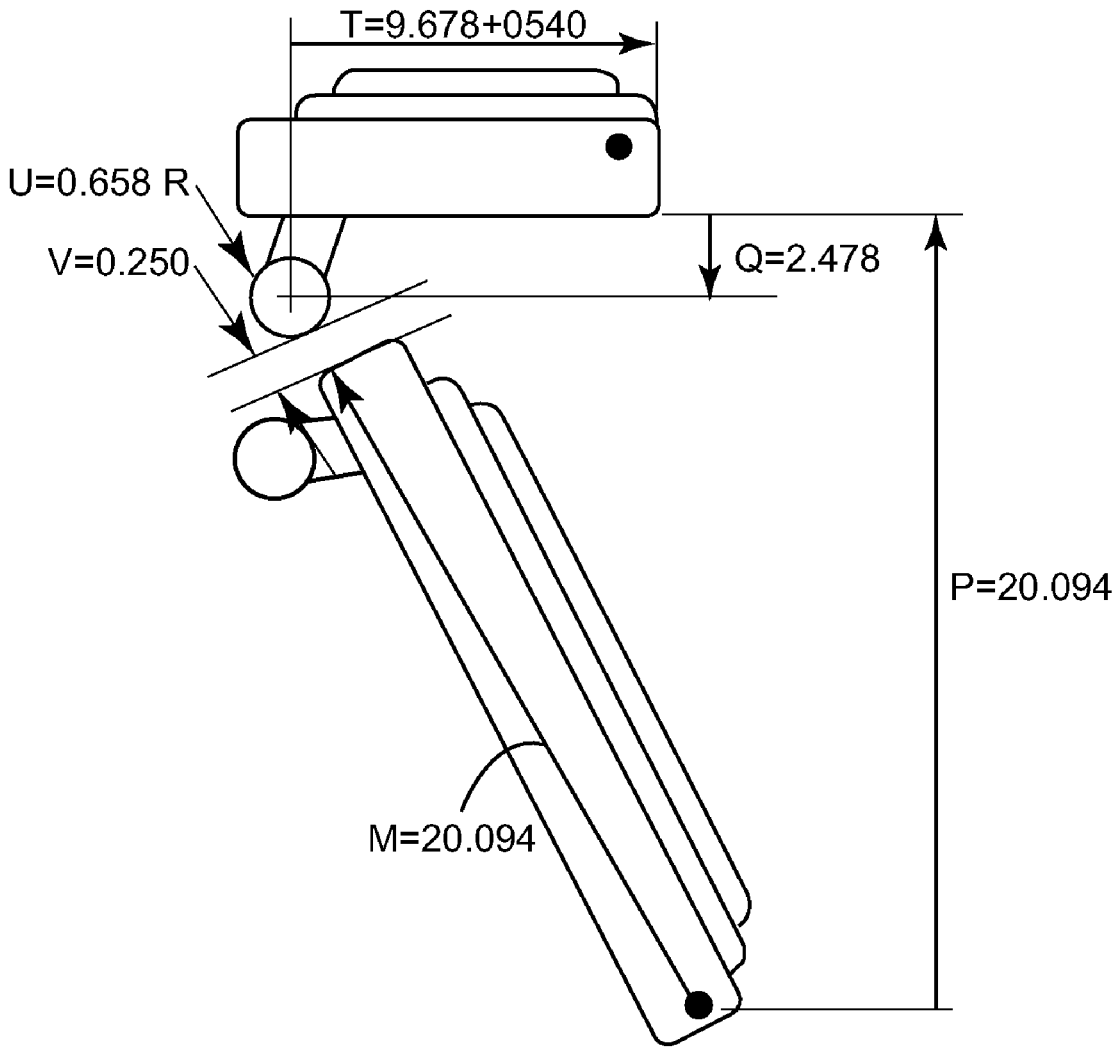
FIG. 9 illustrates a door X translation for the door of FIG. 8 at a position of minimum proximity of both doors of the freestanding dual-cavity unit.

FIG. 8 illustrates the appliance door 10 disposed on a double-oven freestanding unit having a second appliance door 80 for an exemplary embodiment different than the ones previously shown in FIGS. 1-6. As shown in FIG. 8, opening the appliance door 10 by the outlined method permits a minimum gap L between the appliance door 10 and the second appliance door 80 of approximately 5 mm (0.2 in). In addition, when opened by the outlined method, the appliance door 10 of the dual-cavity unit at the fully opened position 60 will be located approximately 6.6 mm (Gap O=0.26 in) from a rack 82 disposed in the upper cavity, thus resulting in a usable height H of approximately 139.7 mm (5.5 in). FIG. 9 illustrates how interference between the two doors of FIG. 8 is avoided by the outlined method. As shown in FIG. 9, closure of the second appliance door 80 is permitted with a gap Q of about 6.35 mm (0.25 in) at the point where the first and second appliance doors are the closest to each other.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments. Finally, in the claims, any means-plus-function clause is intended to cover the structures described herein as performing the recited function and not only structural equivalents, but also equivalent structures.

What is claimed is:

1. A method of opening a door for an appliance, the door having an inner liner, a front surface, and a lower surface, the method comprising:

while rotating the door about a pivot point in a first direction, translating the door from a closed position to a first intermediate position, the pivot point being translated along an X direction away from the appliance by an amount $\Delta x_1$ measured by a horizontal change in distance of the pivot point in the closed position and the pivot point in the first intermediate position with respect to a vertical datum line, and upward along a Y direction by an amount $\Delta y_1$ measured by a vertical change in distance of the pivot point in the closed position and the pivot point in the first intermediate position with respect to a horizontal datum line;

while rotating the door further about the pivot point in the first direction, translating the door from the first intermediate position to a second intermediate position, the pivot point being translated along the X direction away from the appliance by an amount $\Delta x_2$ measured by the horizontal change in distance of the pivot point in the closed position and the pivot point in the second intermediate position with respect to the vertical datum line, and downward along the Y direction by an amount $\Delta y_2$ measured by the vertical change in distance of the pivot point in the closed position and the pivot point in the second intermediate position with respect to the horizontal datum line; and while rotating the door further about the pivot point in the first direction, translating the door from the second intermediate position to an opened position, the pivot point being translated along the X direction away from the appliance by an amount $\Delta x_3$ measured by the horizontal change in distance of the pivot point in the closed position and the pivot point in the opened position with respect to the vertical datum line, and downward along the Y direction by an amount $\Delta y_3$ measured by the vertical change in distance of the pivot point in the closed position and the pivot point in the opened position with respect to the horizontal datum line.

2. The method according to claim 1, wherein $$\Delta x_1=(\mathrm{Gap}_{x,2}+B)-(\mathrm{Gap}_{x,1}+D) \text{ and}$$

$$\Delta y_1=(\mathrm{Gap}_{y,2}+\sqrt{x^2+y^2})-(\mathrm{Gap}_{y,1}+y),$$

where $\mathrm{Gap}_{x,1}$ is a horizontal gap between the inner liner of the door at the closed position and the vertical datum line, $\mathrm{Gap}_{x,2}$ is a horizontal gap between the inner liner of the door at the first intermediate position and the vertical datum line, $\mathrm{Gap}_{y,1}$ is a vertical gap between the lower surface of the door at the closed position and the horizontal datum line, $\mathrm{Gap}_{y,2}$ is a vertical gap between the lower surface of the door at the first intermediate position and the horizontal datum line, D is a horizontal distance from the pivot point to the inner liner, and B is given by:

$$B = \sqrt{D^2 + y^2}\cos\left[90 - \tan^{-1}\left(\frac{x}{y}\right) - \tan^{-1}\left(\frac{D}{y}\right)\right],$$

where x and y are horizontal and vertical distances from the pivot point to the front surface and the lower surface, respectively.

3. The method according to claim 1, wherein $$\Delta x_2=(\mathrm{Gap}_{x,3}+R)-(\mathrm{Gap}_{x,1}+D) \text{ and}$$

$$\Delta y_2=(\mathrm{Gap}_{y,3}+S)-(\mathrm{Gap}_{y,1}+y),$$

where $\mathrm{Gap}_{x,1}$ is a horizontal gap between the inner liner of the door at the closed position and the vertical datum line, $\mathrm{Gap}_{x,3}$ is a horizontal gap between the inner liner of the door at the second intermediate position and the vertical datum line, $\mathrm{Gap}_{y,1}$ is a vertical gap between the lower surface of the door at the closed position and the horizontal datum line, $\mathrm{Gap}_{y,3}$ is a vertical gap between the lower surface of the door at the second intermediate position and the horizontal datum line, D is a horizontal distance from the pivot point to the inner liner, R is given by:

$$R=\sqrt{D^2+y^2}, \text{ and}$$

S is given by:

$$S = \sqrt{x^2 + y^2}\cos\left(90 - \tan^{-1}\left(\frac{x}{y}\right) - \tan^{-1}\left(\frac{D}{y}\right)\right)$$

where x and y are horizontal and vertical distances from the pivot point to the front surface and the lower surface, respectively.

4. The method according to claim 2, wherein $$\Delta x_2=(\mathrm{Gap}_{x,3}+R)-(\mathrm{Gap}_{x,1}+D) \text{ and}$$

$$\Delta y_2=(\mathrm{Gap}_{y,3}+S)-(\mathrm{Gap}_{y,1}+y),$$

where $\mathrm{Gap}_{x,3}$ is a horizontal gap between the inner liner of the door at the second intermediate position and the vertical datum line, $\mathrm{Gap}_{y,3}$ is a vertical gap between the lower surface of the door at the second intermediate position and the horizontal datum line, R is given by:

$$R=\sqrt{D^2+y^2}, \text{ and}$$

S is given by:

$$S = \sqrt{x^2 + y^2}\cos\left(90 - \tan^{-1}\left(\frac{x}{y}\right) - \tan^{-1}\left(\frac{D}{y}\right)\right).$$

5. The method according to claim 1, wherein $$\Delta x_3=(\mathrm{Gap}_{x,4}+y)-(\mathrm{Gap}_{x,1}+D) \text{ and}$$

$$\Delta y_3=(\mathrm{Gap}_{y,4}+x)-(\mathrm{Gap}_{y,1}+y),$$

where $\mathrm{Gap}_{x,1}$ is a horizontal gap between the inner liner of the door at the closed position and the vertical datum line, $\mathrm{Gap}_{x,4}$ is a horizontal gap between the lower surface of the door at the opened position and the vertical datum line, $\mathrm{Gap}_{y,1}$ is a vertical gap between the lower surface of the door at the closed position and the horizontal datum line, $\mathrm{Gap}_{y,4}$ is a vertical gap between the front surface of the door at the opened position and the horizontal datum line, D is a horizontal distance from the pivot point to the inner liner, and x and y are horizontal and vertical distances from the pivot point to the front surface and the lower surface, respectively.

6. The method according to claim 4, wherein $$\Delta x_3=(\mathrm{Gap}_{x,4}+y)-(\mathrm{Gap}_{x,1}+D) \text{ and}$$

$$\Delta y_3=(\mathrm{Gap}_{y,4}+x)-(\mathrm{Gap}_{y,1}+y),$$

where $\mathrm{Gap}_{x,4}$ is a horizontal gap between the lower surface of the door at the opened position and the vertical datum line, and $\mathrm{Gap}_{y,4}$ is a vertical gap between the front surface of the door at the opened position and the horizontal datum line.

7. The method according to claim 1, wherein the door further has an inner lower corner and outer lower corner, and the door is in the first intermediate position when a line passing through the pivot point and the outer lower corner is vertical.

8. The method according to claim 7, wherein the door is in the second intermediate position when a line passing through the pivot point and the inner lower corner is horizontal.

* * * * *

UNITED STATES PATENT AND TRADEMARK OFFICE

CERTIFICATE OF CORRECTION

PATENT NO. : 7,770,330 B2
APPLICATION NO. : 11/959808
DATED : August 10, 2010
INVENTOR(S) : Brown et al.

It is certified that error appears in the above-identified patent and that said Letters Patent is hereby corrected as shown below:

In Column 5, Line 5, delete "$(Gap_{x,2} + B) - (Gap_{x,1} - D)$" and insert -- $(Gap_{x,2} + B) - (Gap_{x,1} + D)$ --, therefor.

Signed and Sealed this
First Day of February, 2011

David J. Kappos

David J. Kappos
*Director of the United States Patent and Trademark Office*